United States Patent [19]

Corse

[11] 4,280,406

[45] Jul. 28, 1981

[54] ROTARY PRINTING MACHINE

[75] Inventor: Louis G. Corse, Chaumont-sur-Tharonne, France

[73] Assignee: Machines Chambon, Orleans, France

[21] Appl. No.: 17,467

[22] Filed: Mar. 5, 1979

[30] Foreign Application Priority Data

Mar. 10, 1978 [FR] France ..... 78 07032

[51] Int. Cl.[3] ..... B41F 5/18; B41F 5/22; B41F 13/36; B41F 13/40

[52] U.S. Cl. ..... 101/177; 101/182; 101/218; 101/227; 101/246; 101/247

[58] Field of Search ..... 101/174, 175, 176, 177, 101/178, 179, 180, 181, 182, 183, 184, 185, 217, 218, 224, 226, 227, 247, 136, 137, 138, 139, 140, 142, 143, 144, 246

[56] References Cited

U.S. PATENT DOCUMENTS

| | | | |
|---|---|---|---|
| 1,025,258 | 5/1912 | Firm | 101/177 X |
| 1,436,653 | 11/1922 | Green | 101/177 X |
| 1,465,386 | 8/1923 | White | 101/177 |
| 2,397,053 | 3/1946 | Schneider | 101/174 X |
| 3,041,966 | 7/1962 | Polglase, Jr. | 101/177 X |

*Primary Examiner*—J. Reed Fisher
*Attorney, Agent, or Firm*—McAulay, Fields, Fisher, Goldstein & Nissen

[57] ABSTRACT

A rotary printing machine for printing several colors on continuously fed sheets comprises a cylinder for driving a web disposed at the web inlet in the printing machine and coupled to a speed variator.

A rotary cutting device is disposed downstream of the web driving cylinder, and means are provided for rotating said rotary cutting device at constant speed. The printing machine also comprises a drum provided on its periphery with regularly distributed grippers, normally closed by springs and of which the opening is controlled by fixed opening ramps.

This drum forms a single large-diameter impression cylinder in contact, at different points of its periphery, with the blanket cylinders of the different printing units. This impression cylinder is mounted to rotate about a horizontal and transverse axis on a support frame mounted for horizontal and longitudinal slide, and means are provided for causing the support frame to slide towards and away from the blanket cylinders of the various printing units.

8 Claims, 2 Drawing Figures

51
53
54
49
86d
48
34d
37d
43d
44d
83d
98d
94d
95d
93d
97d
98c
98b
98a
96d
64
43c
44c
34c
37c
36c
92b
89b
76
77
79
81
91b
34b
37b
43b
44b
86b
83b
88b
85b
84b
34a
83a
85a
82a
37a
84a
27
78
86a
44a
43a
55
56
52
57

ROTARY PRINTING MACHINE

BACKGROUND OF THE INVENTION

The present invention relates to a rotary printing machine for printing several colours on continuously fed sheets.

Printing machines are already known for printing several colors on sheets, particularly on cardboard sheets, these printing machines comprising a plurality of printing units corresponding to the different colors. These printing machines have the major drawback that, when it is desired to modify the format of the print, they necessitate a change of equipment i.e. the cylinders, which takes up a relatively long period of time. In the case of printing short series, i.e. comprising a relatively low number of printed sheets of the same format, the time required for replacing equipment may be equal to the time for actually printing the series in question.

To reduce the time necessary for changing equipment, during which the printing machine is immobilized, it has already been envisaged to produce machines in which the impression cylinders, and more particularly for each color, the blanket cylinder and the plate cylinder in the case of an offset printing machine, are mounted on the same frame which is transversely movable with respect to the framework of the machine. It is thus possible, in the case of a change of format, to replace the whole of a frame previously in operation with cylinders corresponding to the previously used format, by another similar frame, waiting outside the machine and carrying cylinders corresponding to the new format which has to be used. This arrangement requires, however, the provision of as many frames and consequently as many groups of pairs of cylinders as there are formats envisaged for printing. It is obvious that such a solution is particularly expensive.

SUMMARY OF THE INVENTION

It is an object of the present invention to remedy these drawbacks by providing a rotary printing machine enabling prints to be made on sheets of varying format without considerable loss of time during the periods when the plates serving for printing are changed, and without wasting printed matter.

To this end, this rotary printing machines for printing in several colors on continuously fed sheets, comprises a frame on which a plurality of printing units are mounted one above the other, each said printing units respectively ensuring the printing of the different color and each comprising an inking unit and a plurality of ink transfer rollers having horizontal axes transverse to the frame, the ink rollers being tangential to one another and including an inking roller receiving a film of ink, a plate cylinder, a blanket cylinder for contact with the sheets, the inking rolls and the inking units being mounted on the frame in determined positions, while the plate cylinders and the blanket cylinders of the various printing units are mounted to rotate together first on a support frame movable horizontally and transversely with respect to the frame, so as to be able to be completely removed from the frame, and means for rotating all the cylinders of the printing units, means for continuously feeding a web of material to be printed and for introducing it into the printing machine, a cylinder for driving the web disposed at the inlet thereof in the printing machine and coupled to a speed variator enabling the linear speed of the web to be regulated as a function of the format desired for the sheets, a rotary cutting device disposed downstream of the web driving cylinder, means for rotating this rotary cutting device at constant speed so as to cut from the web successive sheets of adjustable constant formula, a drum provided on its periphery with regularly distributed grippers, normally closed by springs and of which the opening is controlled by fixed opening ramps, these grippers being adapted to grip the front edge of each sheet separated by the rotary cutting device, this drum forming a single impression cylinder of large diameter in contact at different points of its periphery with the blanket cylinders of the different printing units, a second support frame mounted for horizontal and longitudinal sliding movement with respect to the frame and on which the impression cylinder is mounted to rotate and means for sliding the second support frame towards and aways from the blanket cylinders of the plurality printing units.

The rotary printing machine according to the invention offers the advantage over a conventional printing machine printing on sheets, that a reel is used and not pre-cut sheets, and that it is possible to adjust the format of the sheets to be printed, as desired, simply by regulating the speed of advance of the web when entering the machine.

Furthermore, another advantage procured by the printing machine according to the invention is that, whatever the format of the print, the same impression cylinders are used, the only change to be made concerning the replacement of the plates of which the etched parts are variable as a function of the format.

In addition, as the feed of the web is always adapted to the format of the print, the surface of the various sheets may be used to a maximum for printing and there is no loss of material on which printing takes place.

The invention will be more readily understood on reading the following description with reference to the accompanying drawings, in which.

Figure 1:
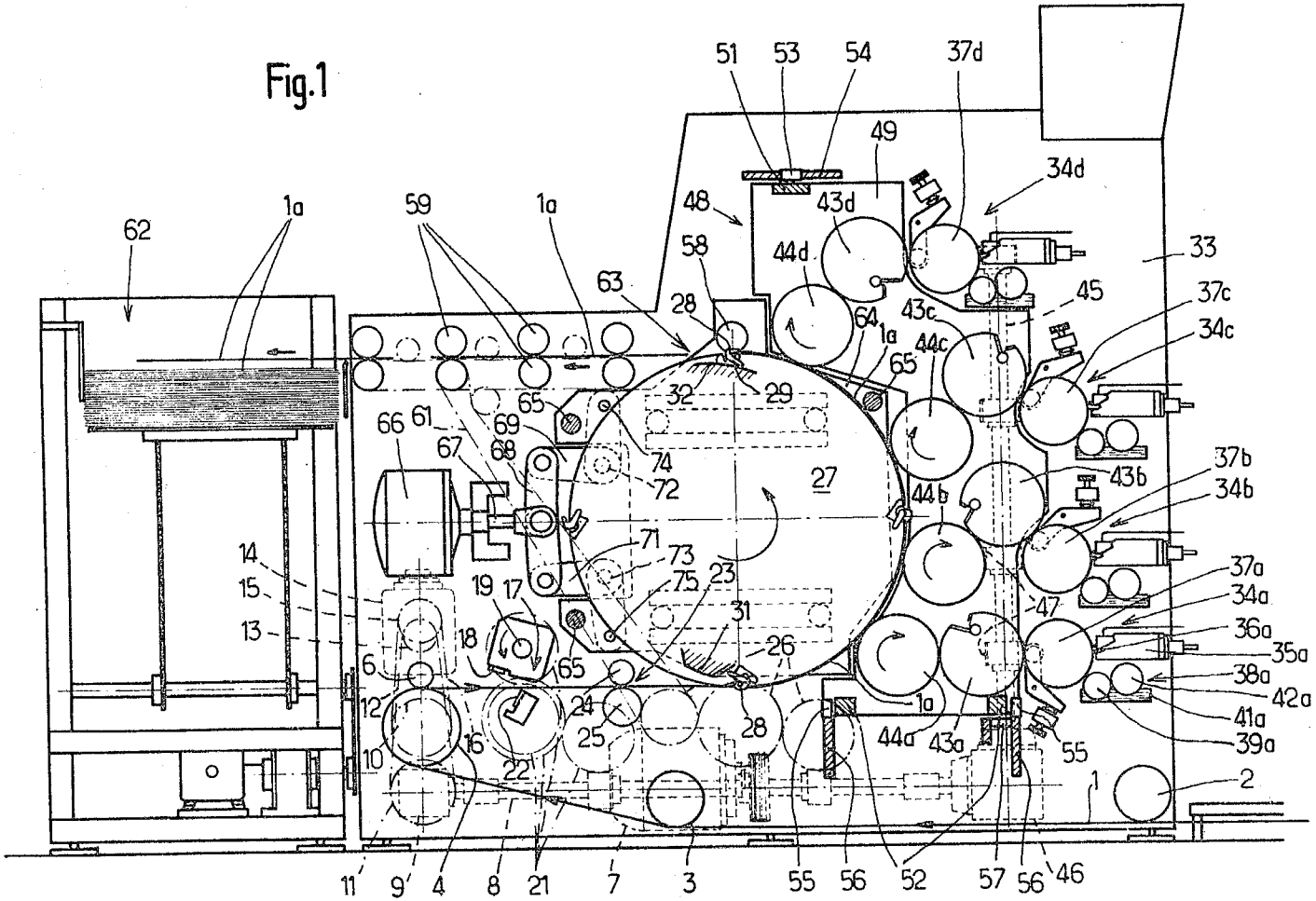
FIG. 1 is a schematic view in vertical and longitudinal section of multi color rotary printing machine, intended for printing on sheets cut from a continuously fed web.

Referring now to the drawings, the multi-color rotary printing machine shown in FIG. 1 is more particularly intended for printing on successive sheets from a continuously fed web 1, for example a web of cardboard. Printing may thus be effected on sheets of carboard of length varying as a function of the format chosen for the print.

The carboard web 1 is introduced into the printing machine in its lower part, on the right-hand side, and it passes beneath guide rollers 2 and 3 of horizontal and transverse axes, in the same way as all the other guide rollers and other cylinders of the printing machine. The web 1 then passes over a guide cylinder 4 located in the lower left-hand part of the printing machine, and is guided towards the right at the top of this cylinder where it is presses by an upper impression cylinder 6. The guide cylinder 4 is driven in rotation from an electric motor 7 coupled to a general control shaft 8 which extends horizontally and longitudinally in the lower part of the printing machine. This shaft 8 is coupled by a level gear 9, to a toothed wheel 11 connected, via a notched belt 12, to an inlet gear 13 of a speed variator 14. This variator further comprises an outlet gear 15 which is coupled, via a belt 16, to a toothed wheel 10 fast with the shaft of the guide cylinder 4. This variator therefore enables the speed of advance of the web 1 to be varied as desired, as a function of the format.

This web then passes through a rotary cutting device 17 which essentially comprises a rotary cutter 18 fast with a shaft 19, disposed above the web 1 and rotated from the general control shaft 8 via a gear train 21. The rotary cutting device 17 also comprises a fixed counter-cutter 22 located under the web and their inclination with respect to the longitudinal direction of advance of the web may be adjusted as a function of the speed thereof. A rotary cutting device 17 of this type is well known in the art and will therefore not be described in detail.

As the mobile cutter 18 rotates at a predetermined constant speed whilst the speed of advance of the web 1 may be regulated by means of the speed variator 14, it will be appreciated that, upon each revolution of the cutter 18, in other words at each cutting cycle, this cutter separates from the web 1 a length of sheet 1*a* which is as large as the speed of the web is high.

Downstream of the rotary cutting device 17 there is a pulling unit 23 constituted by two upper and lower cylinders 24 and 25, respectively in elastic pressure on each other. The lower cylinder 25 is driven in rotation, from the horizontal general control shaft 8, via a gear train 26 so that the unit 23 extracts each separate sheet 1*a* leaving the rotary cutting device 17 at a linear speed greater than that of the web and also slightly greater than that of an impression cylinder drum 27 of horizontal and transverse axis which is located above and to the right of the pulling unit 23. This impression cylinder drum 27 is driven in rotation in anticlockwise direction by the electric motor 7, via the gear train 26. This drum 27 carries on its periphery a number n of pairs of grippers 28, for example four in the example illustrated in the drawing, these pairs of grippers being regularly distributed about the axis of the impression cylinder 27. The two grippers 28 of the same pair are located at the two ends of the periphery of the drum so as to be able to grip the front edge of each sheet, near its ends. These grippers are normally maintained closed by springs (not shown) and they comprise arms 29 carrying at their ends rollers adapted to roll on fixed opening ramps 31, 32 mounted respectively in lower and upper positions on two vertical and longitudinal uprights 33 constituting the frame of the printing machine. The lower opening ramp 31 is disposed near the lowest generatrice of the impression cylinder drum 27 so as to provoke the opening of each gripper 28, a little before said latter reaches the lowest position and so that it may thus receive, in open position, the front edge of each cut out sheet which is then taken along by the pulling unit 23 at a linear speed slightly greater than that of the drum 27. The ramp 31 then allows the automatic closure of each grip 28, under the action of its spring, so that, from this moment, the front edge of the sheet is firmly gripped by the grippers 28 and may hence forth be rotated by the impression cylinder drum 27. The multi-color printing operations then take place, this printing being effected by a plurality of printing units, for example four in number in the example described, such as printing units 34*a*, 34*b*, 34*c*, 34*d*. These printing units are all composed of the same constituent elements and consequently only one of them will be described in detail, namely the first printing unit encountered by the sheets 1*a* previously cut out from the web 1. The first printing unit 34*a* is the lowest one in the printing machine and it essentially comprises an inking unit 35*a* with inking rod 36*a* immersed in a mass of ink, applied under pressure against an inking roller 37*a* of horizontal and transverse axis and having a surface composed of supple material, for example, rubber. The printing unit 34*a* further comprises a damping device 38*a* in the case of offset printing which comprises a damping cylinder 39*a* with a chromium plated surface immersed in a pan 41*a* containing a damping solution and in contact with a doctor 42*a* and with the inking roller 37*a*. This inking roller 37*a* is also tangential to a photogravure or plate cylinder 43*a*, of horizontal and transverse axis, and this latter is in turn tangential to a blanket cylinder 44*a* in contact with the impression cylinder drum 27 of which the development is quadruple that of the plate cylinders.

The axes of rotation of the inking roller 37*a*, plate cylinder 43*a* and blanket cylinder 44*a* of the first lower printing unit 34*a* are located in the same horizontal plane whilst the axes of the three corresponding cylinders forming part of the upper printing units 34*b*, 34*c* and 34*d* are not coplanar. This enables the machine according to the invention to be more compact and, with this arrangement, the axes of rotation of the three inking rollers 37*a*, 37*b*, 37*c*, of the first second and third printing units 34*a*, 34*b*, and 34*c* are disposed in the same vertical plane, the axis of rotation of the inking roller 37*d* of the fourth uppermost printing unit 34*d* being offset towards the inside of the machine with respect to the said vertical plane.

All the cylinders of the printings units may thus be driven in rotation from one and the same vertical general control shaft 45 which is driven from the horizontal general control shaft 8, via a level gear 46. The movements are transmitted from endless screws 47 carried by the vertical control shaft 45, via gear trains coupled with gears fast with the shafts of the different cylinders.

The plate cylinders 43*a*, 43*b*, 43*c* and 43*d* and the blanket cylinders 44*a*, 44*b*, 44*c* and 44*d* of the various printing units are mounted to rotate on a mobile support frame 48 which is movable horizontally and transversely with respect to the frame formed by the longitudinal uprights thereof 33 of the printing machine. This support mobile frame 48 is constituted by two vertical and longitudinal uprights 33 49, disposed along the uprights constituting the frame of the printing machine. These uprights are connected together by crosspieces, namely an upper cross piece 51 and two lower crosspieces 52.

The upper cross piece 51 carries rollers 53 of vertical axes rolling in a transverse guide 54 extending between the two longitudinal uprights 33 of the frame of the printing machine. The lower crosspieces 52 carries rollers 55 of horizontal and longitudinal axes, these rollers rolling on fixed crosspieces 56 between the uprights 33 of the frame of the printing machine, one of the mobile crosspieces 52 also carrying a roller 57 of vertical axis rolling in a transverse guide track.

The whole of the frame 48, with the pairs of plate and blanket cylinders which are mounted to rotate thereon, may thus be extracted entirely from inside the printing machine and removed therefrom with a view to changing format.

The successive sheets 1*a* thus receive different colored prints which are applied thereto by the successive printing units 34*a*, 34*b*, 34*c* and 34*d*, effecting a rotation through 180° about the axis of the impression cylinder drum 27.

When the pairs of grippers 28 carried by the impression cylinder drum reach the highest point of their path, their arms 29 meet, via the rollers that they carry, the opening ramps 32 which then provoke the opening of these grippers and the release of the front edges of each printed sheet. At this spot, the sheet is caught between the impression cylinder drum 27 and an upper pulling cylinder 58 of horizontal and transverse axis, pressed elastically on the impression cylinder drum. The printed sheet, after having been released, is thus ejected towards a set of pulling rollers 59, disposed in pairs of upper and lower rollers between which each sheet 1*a* passes. These pulling rollers are driven in rotation from the horizontal general control shaft 8, via the gear train 26 and a belt transmission 61. The pulling rollers 59 conduct the printed sheets to a receiving and stacking device 62, in which the printed sheets 1*a* are stored on one another.

After having thus described the general architecture of the rotary printing machine according to the invention, certain particular features of this structure will now be specified.

The impression cylinder drum 27 is carried as a whole by a support frame 63 constituted by two vertical and longitudinal uprights 64, adjacent the uprights 33 forming the frame of the printing machine, these uprights being connected by horizontal crosspieces 65. All of the frame 63 is mounted for horizontal and longitudinal sliding with respect to the frame formed by the two vertical and longitudinal uprights 33 of the printing machine. This movement is controlled by a pair of pneumatic jacks 66. The rod 67 of each of these jacks 66 is articulated on two connecting rods 68, 70 of which the ends are articulated on arms of two upper and lower angle levers 69 and 71 respectively, themselves articulated on the uprights of the adjacent frame about horizontal and transverse axes 72, 73. The second arms of the levers 69, 71 are respectively articulated, at their ends, about axes 74, 75, on an upright 64 of the frame 63. Thus, in FIG. 1, when the rod 67 of the pneumatic jack 66 moves towards the left, the levers 69, 71 pivot about their axes 72 and 73, this provoking a translation towards the left of the frame 63 and the impression cylinder drum 27 which it carries, so that this drum is moved away from the blanket cylinders 44*a*–44*d*. A reverse supply of the jack 66 provokes a correlative movement of the rod 67 and a slide towards the right of impression cylinder drum 27, this drum then being pressed against the blanket cylinders 44*a*–44*d*.

Figure 2:
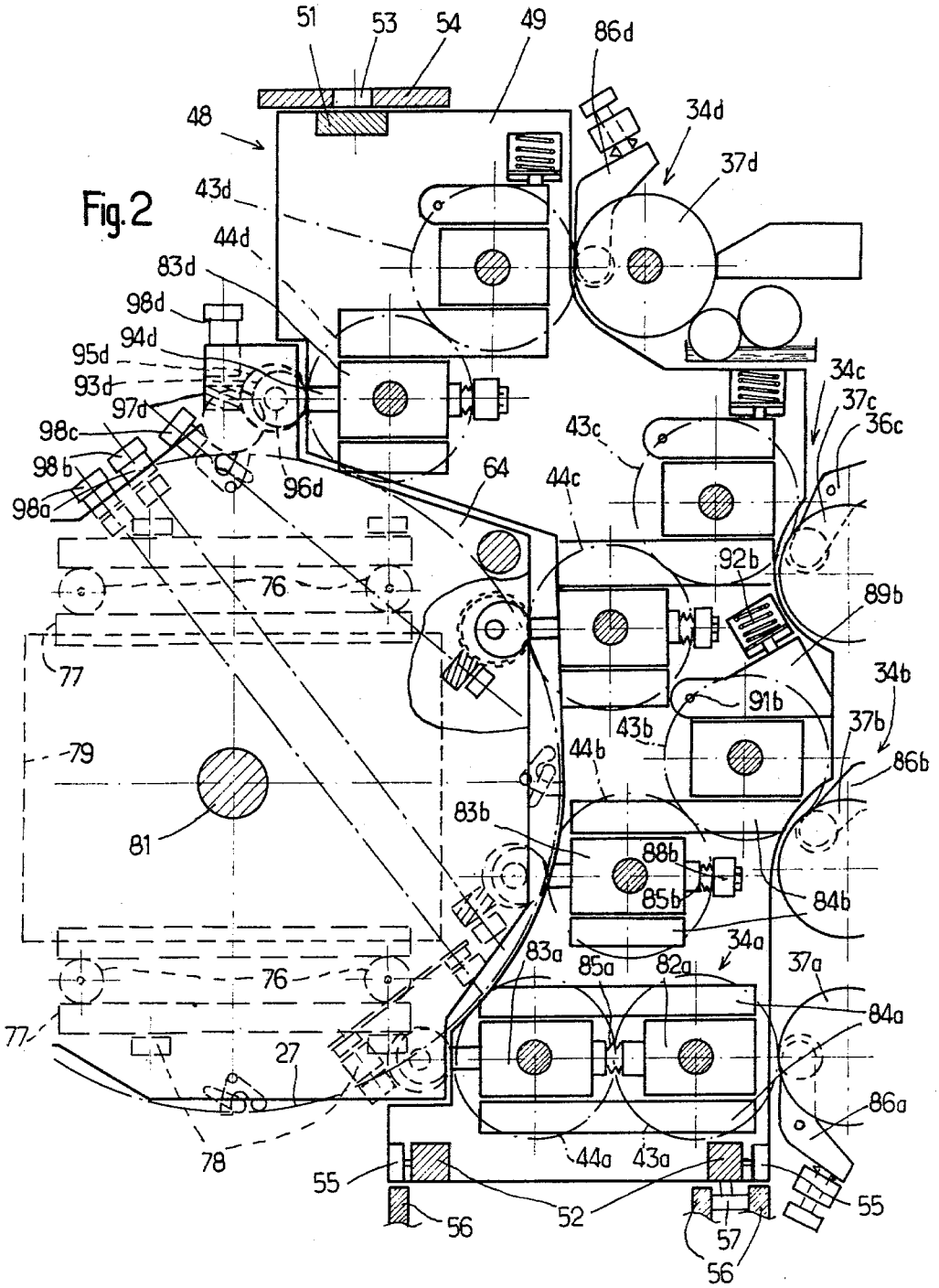
FIG. 2 is a view in partial vertical and longitudinal section, on a larger scale, of the impression cylinder and cylinders tangential to said latter and to one another.

The guiding of the mobile frame 63 with respect to the frame formed by uprights 33 of the printing machine may be effected in different ways. As is illustrated in FIG. 2, each of the uprights 64 of the mobile frame 63 carries rollers 76 of horizontal axes rolling on horizontal guide rails 77 fixedly mounted on the frame formed by the uprights 33 of the machine. Other rollers 78, of vertical axes, may be provided to ensure a transverse guiding of the sliding frame 63.

FIG. 2 also shows one of the bearings 79 carried by the mobile frame 63 and in which the shaft 81 of the impression cylinder shaft 27 swivels.

Certain constructive features of the various printing units will now be described with particular reference to FIG. 2.

In the lower most printing unit 34*a*, the bearings 82*a* and 83*a* in which the shafts of the plate cylinder 43*a* and blanket cylinder 44*a* respectively swivel, are mounted to slide between horizontal guide strips 84*a* fixedly mounted on the two uprights 49 of the transversely mobile frame 48. Between the bearings 83*a* and 82*a* are disposed compression springs, such as conical washers 85*a* which thus tend to move the two cylinders 43*a*, 44*a* apart when no pressure is exerted thereon. Furthermore, an adjustable stop 86*a*, constituted by a twoarmed lever articulated about a horizontal and transverse axis, is provided to adjust the "touch", in other words the penetration of the plate cylinder 43*a* in the supple material constituting the peripheral layer of the inking roller 37*a*. This stop which abuts on each roller track of the plate cylinder 43*a* comprises a compression spring 87*a*, constituted for example by conical washers, which, when the impression cylinder drum 27 is no longer under pressure, enables the plate cylinder 43*a* to be moved away from the inking roller 37*a*.

As has been seen previously, in the three upper printing units 34*b*, 34*c*, 34*d*, the axes of the different cylinders are not coplanar, in order to allow the drive of all these cylinders from the vertical control shaft 45 alone.

As the assembly of the bearings of the plate and blanket cylinders is the same in these three units, only one of them will be described in detail, namely the second unit 34*b* from the bottom. In this unit, each of the bearings 83*b* carrying the shaft of the blanket cylinder 44*b* is mounted for horizontal and longitudinal slide between two horizontal guide strips 84*b* fixed to an upright 49 of the frame 48. Each bearing 83*b* is pushed in the direction of the impression cylinder drum 27 by a compression spring 85*b*, for example a stack of conical washers, which bears on the one hand on a fixed stop 88*b* and on the other hand on the bearing 83*b*.

The plate cylinder 43*b* is mounted a little above the inking roller 37*b* and the blanket cylinder 44*b* and each of its bearings is mounted for horizontal and longitudinal sliding between a lower horizontal guide strip, which may be constituted by the extension of the upper guide strip of the bearing 83*b*, which is fixedly mounted on the uprights 49, and an upper guide strip 89*b* which is articulated, at its left-hand end in the drawing, about a horizontal and transverse axis 91*b*. A return spring 92*b* acts on the pivoting upper strip 89*b* so as constantly to push said latter downwardly. In this way, when pressure is applied, i.e. when the impression cylinder drum 27 is applied against each of the blanket cylinders, the plate cylinders 43*b*, 43*c* and 43*d* of the second, third and fourth printing units may be positioned correctly, the slight vertical movement which results from the non-coplanar arrangement of the axes of the cylinders being absorbed by the upper pivoting strips such as strip 89*b*.

The three upper printing units 34*b*, 34*c*, 34*d* respectively comprise, like the lower unit, adjustable stops 86*b*, 86*c*, 86*d* urged by compression springs and enabling the touch between the various plate cylinders and inking rollers associated therewith, to be adjusted.

Means are also provided to adjust the "touch" between the impression cylinder drum 27 and the various blanket cylinders. As these means are made in the same manner for the four printing units, only those associated with the fourth printing unit 34*d* located uppermost in the printing machine, will be described in detail. These means comprise, on each of the vertical uprights 64 of the horizontally and longitudinally mobile frame 63, a cam 93*d* which may come into contact with a horizontal column 94*d* in contact with the left-hand vertical face of the bearing 83*d* supporting the shaft of the blanket cylinder 44*d*. This cam 93*d* is fast with an endless screw wheel 95*d* via a horizontal and transverse shaft 96*d*, the endless screw wheel 95*d* being in mesh with an endless screw 97*d* fast with a knob 98*d* for adjusting the touch. Thus, by rotating this knob in one direction or the other, a rotation of the cam 93*d* is provoked and the maximum position which the impression cylinder drum 27 may attain towards the right when the printing cylinders are pressed, may thus be regulated; in other words the touch between the impression cylinder drum 27 and the blanket cylinder 44*d* is regulated in this way.

Similar touch regulating mechanisms are provided for all the other printing units, the corresponding adjusting knobs 98*a*, 98*b* and 98*c* being grouped in the upper part of the machine, near one another, in order to facilitate these adjustments. The connections between these regulating knobs and the various cams are made by means of inclined shafts and possibly gear transmissions.

Although in the above-described example, the rotary printing machine according to the invention comprises four printing units, it is obvious that it may comprise a different number corresponding to the number of colors to be applied. In each case in question, the impression cylinder drum 27 has a development equal to n times that of the plate cylinder of a printing unit, if the printing machine comprises n of these units. The drum also carries n pairs of grippers 28 distributed regularly about the axis of this drum.

What I claim is:

1. A rotary printing machine for multi-color printing continuously fed sheets, comprising:

a frame on which a plurality of printing units are mounted on one another, ensuring respectively the printing of the different colors;

each said printing unit comprising an inking unit and a plurality of ink transfer rollers having horizontal axes transverse to said frame, said ink rollers being tangential to one another and including an inking roller receiving a film of ink, a plate cylinder, a blanket cylinder for contact with the sheets, said inking units and the inking rolls being mounted on said frame in determined positions, and said plate cylinders and the blanket cylinders of the various printing units being mounted to rotate together on a first support frame movable horizontally and transversely with respect to the frame, so as to be able to be completely withdrawn from the frame;

means for rotating all of the cylinders of each of the said printing units;

means for continuously feeding a web of material to be printed and for introducing it into the printing machine;

means for regulating the linear speed of the web as a function of the format desired for the sheets;

a rotary device for cutting the web;

means for rotating said rotary cutting device at constant speed so as to cut from the web successive sheets of adjustable constant format;

a drum provided at its periphery with regularly distributed grippers, normally closed by springs, the opening of said grippers being controlled by fixed ramps on said frame, said grippers being adapted to grip the front edge of each sheet separated by said rotary cutting device, wherein said drum forms a single large diameter impression cylinder in contact, at different points of its periphery, with the blanket cylinders of said different printing units, said drum being mounted to rotate about a horizontal axis transverse to said frame on a second support frame, said second support frame being mounted for horizontal and longitudinal sliding movement with respect to said frame; and, means for sliding the said second support frame towards and away from the blanket cylinders of the said plurality of printing units.

2. A rotary printing machine as claimed in claim 1, further including a speed variator; and, a cylinder for driving the web coupled to said speed variator and disposed at the web inlet in the printing machine.

3. A rotary printing machine as claimed in claim 1, including a pulling unit constituted by two upper and lower cylinders in elastic pressure on each other between said rotary cutting device and said impression cylinder; and, means for rotating one of said two upper and lower cylinders at a linear speed greater than that of said web and also slightly greater than the peripheral speed of said impression cylinder.

4. A rotary printing machine as claimed in claim 1, 2 or 3, wherein said impression cylinder has a diameter equal to a multiple of the diameter of each plate cylinder in each said printing units.

5. A rotary printing machine as claimed in claim 9, wherein said second support frame supporting said impression cylinder comprises:

said frame mounting said printing units having members forming uprights;

two vertical and longitudinal uprights adjacent the uprights of the frame mounting said printing units being connected by horizontal crosspieces;

means for guiding the sliding of the vertical and longitudinal uprights of said second movable frame for longitudinal and horizontal sliding including rollers of horizontal axes rolling on horizontal guides carried by the uprights constituting the frame mounting said printing units and rollers of vertical axes providing a lateral guide of said second movable frame; and, at least one pneumatic jack for controlling the horizontal and longitudinal movement for the said second movable frame, and a connecting mechanism for connecting said rod and said jack to said second movable frame.

6. A rotary printing machine as claimed in claim 1, wherein said inking unit, said plate cylinder and said blanket cylinder forming the first and lowermost printing unit are horizontally aligned;

said first movable frame having members forming uprights;

the respective bearings of said plate cylinder and said blanket cylinder being mounted for horizontal sliding between horizontal guide strips fixed to the uprights of said first movable frame;

compression springs are disposed between the parts of said plate cylinder and said blanket cylinder; and, the other printing units located above the first printing unit comprise plate cylinders and blanket cylinders of which the axes are located in different planes, the bearings of said blanket cylinders being mounted for horizontal and longitudinal sliding between horizontal guide strips fixed to the uprights of said first movable frame and the bearings of said plate cylinders of these printing units are mounted for horizontal and longitudinal sliding between lower horizontal guide strips fixed to the uprights of said first support frame, and upper horizontal guide strips articulated about horizontal and transverse axes and permanently urged downwardly by springs.

7. A rotary printing machine as claimed in claim 6, wherein each said printing unit comprises:

a pivoting adjustable stop, said stop abutting against the support of the plate cylinder of the corresponding printing unit, and said stop being adjustable to determine the touch of the plate cylinder with the corresponding inking roll; and, a compression spring acting via said stop on the plate cylinder so as to move said plate cylinder away from the inking roll associated therewith when the printing unit is no longer under pressure.

8. A rotary printing machine as claimed in claim 1, further including means for regulating the touch of the impression cylinder with each of the blanket cylinders of the various printing units;

a bearing supporting each end of each blanket cylinder shaft; and said regulating means being provided for each bearing of each said blanket cylinder and comprising a cam coupled via a transmission mechanism to a knob for regulating the touch, said cam abutting against a regulating column itself in abutment against an adjacent face of the bearing supporting the shaft of each said blanket cylinder.

* * * * *